United States Patent [19]

Hong

[11] Patent Number: 4,953,430

[45] Date of Patent: Sep. 4, 1990

[54] SEVERED ADHESIVE TAPE SUPPLYING DEVICE

[76] Inventor: Myeon K. Hong, 21-88, Haweolgok-dong, Seongbuk-ku, Seoul, Rep. of Korea

[21] Appl. No.: 281,396

[22] Filed: Dec. 8, 1988

[30] Foreign Application Priority Data

Dec. 8, 1987 [KR] Rep. of Korea ..... 87-13960

[51] Int. Cl.[5] ..... B26D 5/20

[52] U.S. Cl. ..... 83/155; 83/161; 83/241; 83/649; 83/922; 156/519

[58] Field of Search ..... 83/161, 649, 273, 203–205, 83/241, 922, 28, 155; 156/519

[56] References Cited

U.S. PATENT DOCUMENTS 3,293,967 12/1966 Sharpe ..... 83/241
3,353,432 11/1967 Philippi ..... 83/922 X
3,587,376 6/1971 Hirano ..... 83/203 X
3,802,309 4/1974 Bosland ..... 83/649 X
4,099,433 7/1978 Muto ..... 83/155

FOREIGN PATENT DOCUMENTS 1061236 12/1980 Japan .

*Primary Examiner*—Frank T. Yost
*Assistant Examiner*—Eugenia A. Jones
*Attorney, Agent, or Firm*—Birch, Stewart, Kolasch & Birch

[57] ABSTRACT

An adhesive tape delivering, cutting, and supplying device which includes a tape delivering member, a tape transferring member from a roll tape to a tape to be cut, a cutting member, and a tape supply member for attaching the tape to a rotary ring, whereby the tape can be prevented from sticking the tape to a conveyor belt or from being rolled thereinto.

6 Claims, 7 Drawing Sheets

SEVERED ADHESIVE TAPE SUPPLYING DEVICE

BACKGROUND OF THE INVENTION

1. Field of the Invention

The present invention relates to an adhesive tape delivering, cutting, supplying device which is designed to supply and cut a certain desired length of the adhesive tape required by the user and particularly to a device for smoothly delivering the tape from the device and preventing the tape from being rolled up or from hanging down.

2. Description of the Prior Art

Many types of adhesive tape devices have heretobefore been proposed and for example, in order to stick an adhesive tape when a commodity is packed, a wound roll tape has been drawn out little by little and cut by knives or scissors, or a tape wound in a case provided with sawteeth has been widely used. However, such tapes are limited in the ability of supply as compared with a length of packing time in such places as department stores, supermarkets, and other placed requiring a large number of packing operations. The conventional devices are not only unduly complicated for packing operations but also their irregular configuration adversely affects the overall appearance of the packed commodities.

According to the Japanese Patent No. 1,061,236 entitled "an automatic tape cutting device" owned by the inventor of the present invention, it is notable to be broken off from the category of manual work.

Also, according to Korean patent application Ser. No. 85-4315 filed by the inventor of the present invention, it is notable for the adhesive tape to stick to the conveyor belt.

However, the prior art tape cutting devices suffer from number of disadvantages such as, for example, since the wound tapes are located in the outside of the devices, therein-operation parts are formed in the outside of a main body of the devices so as to deliver the tape to its cutting part. Therefore, they are required to enlarge their outer shape.

Furthermore, since they have a very complicated structure, it is difficult to repair and a high cost to manufacture.

SUMMARY OF THE INVENTION

Accordingly, an object of the present invention is to provide an improved tape delivering, cutting, and supplying device for covering up the deficiencies of the prior art automatic tape devices.

Another object of the present invention is to provide an automatic tape device for producing satisfactory results by delivering a tape and cutting it within its body.

A further object of the present invention is to provide a tape device which is structured with a ring-shaped supply member.

Still another object of the present invention is to provide a tape cutting device which is structured with a conveyor belt which keeps the tape from being rolled up and prevents the tape from sticking to the conveyor belt.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an adhesive tape delivering, cutting, and supplying device which includes a tape delivering member, a tape transferring member from a roll tape to a tape to be cut, a cutting member, and a tape supply member for attaching the tape to a rotary ring, whereby the tape can be prevented from sticking the tape to a conveyor belt or from being rolled thereinto.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
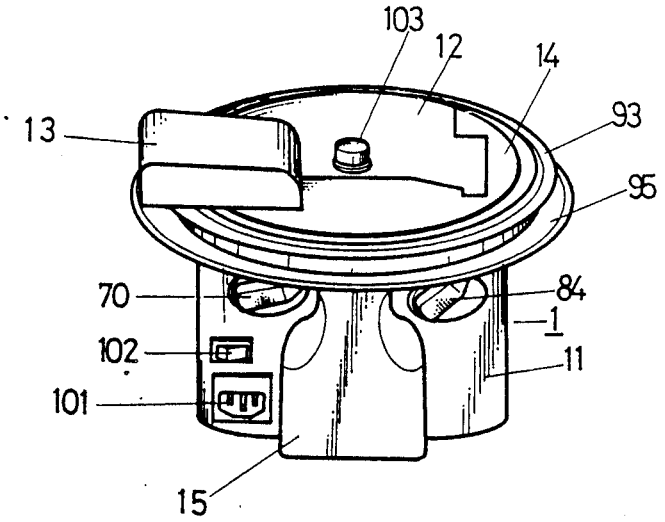
FIG. 1 is a perceptive view of an adhesive tape cutting and supplying device of the present invention.
Figure 2:
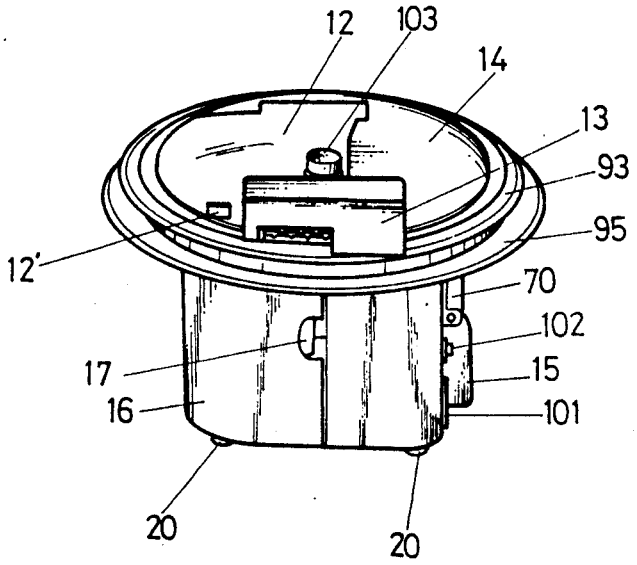
FIG. 2 is a perceptive view of the adhesive tape cutting and supplying device of the present invention.

Referring now in detail to the drawings for the purpose of illustrating preferred embodiments of the present invention, the adhesive tape supplying and cutting apparatus as shown in FIGS. 1 to 4 comprises a body a tape supplying ring 93, a tape drooping prevention ring 95 mounted to the top of the body 1, and a tape drawing cap 13 disposed on the tape supplying ring 93.

The body 1 includes a cover 11 set with a shaft plate 23, a door 16, and a plate 19. On a pair of raised end portions 25 of the shaft plate 23, the tape supply ring 93 is tightly seated through a gear installing frame. The tape drawing cap 13 and a door cap 12 projectingly formed on a fixing cap 14 are attached to the gear installing frame 91 integrated with the tape supply ring 93. The door cap 12 is movably attached by a pin 27 to a supporting frame 26 disposed on the shaft plate 23 and a suspension removal press pin 103 is disposed on the center of the door cap 12.

As shown in FIG. 1, a plug 101 and a main switch 102 are disposed on the outside of the cover 11. A tape drawing length control dial 70 and a rotation range control dial 84 are projectingly formed on either side of a motor cover 15.

A door hanger 17 is attached to the door 16. A machine tool storage pocket 18 is formed in the inside of the door 16. A door cap holding handle 12' is attached to the door cap 12. The body 1 is provided with a plurality of bars 20' disposed on the bottom thereof.

Figure 3:
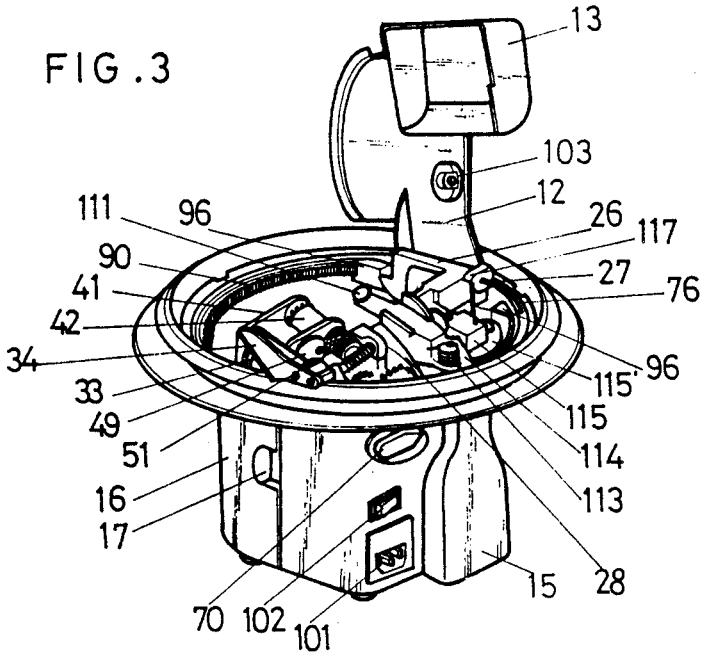
FIG 3 is a perceptive view of the adhesive tape cutting and supplying device of the present invention in the open position of a door thereof.
Figure 4:
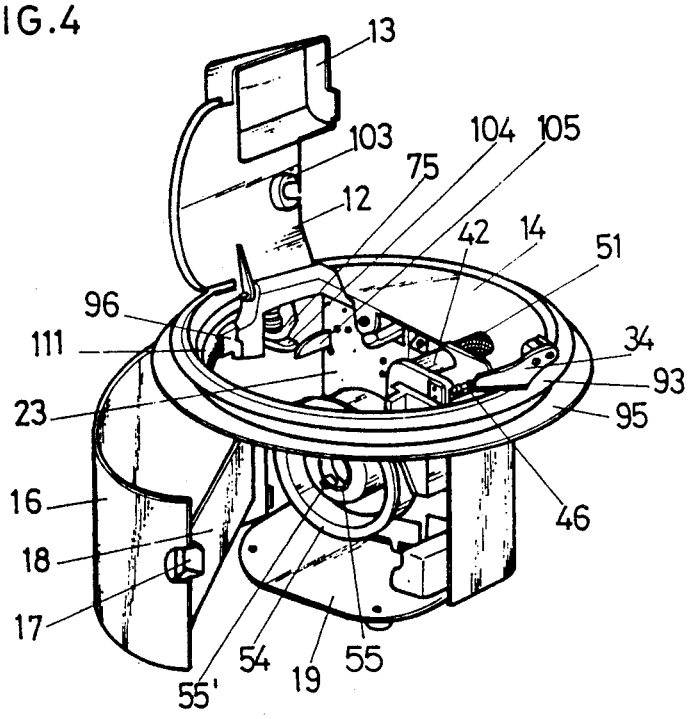
FIG. 4 is a perceptive view of the adhesive tape cutting and supplying device of the present invention in the open position of the door and a base member thereof.

As shown in FIGS. 3 and 4, an operation part is disposed on one side of the shaft plate 23 and, on the other side thereof, a tape installing frame 54 is movably inserted into an installing frame attachment ring 55 having an elastic attachment member 55'. A tape drawing roller installing frame 41 is movably inserted into the upper end on one side of the shaft plate 23. In order to stably maintain the rotation of a ratchet gear 90, four gear installing members 96 are mounted on the gear installing frame 91.

Figure 7:
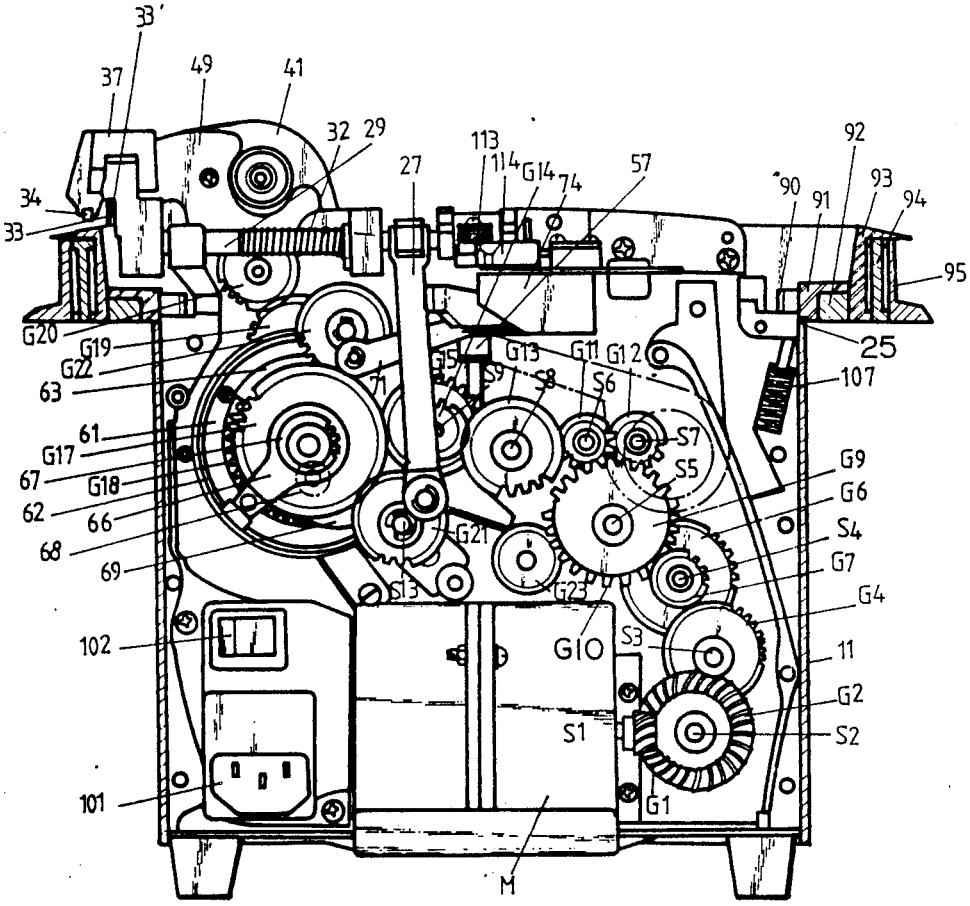
FIG. 7 is a front view of the adhesive tape cutting and supplying device of the present invention showing in cut away the door, the tape attached ring and a cover thereof.
Figure 8:
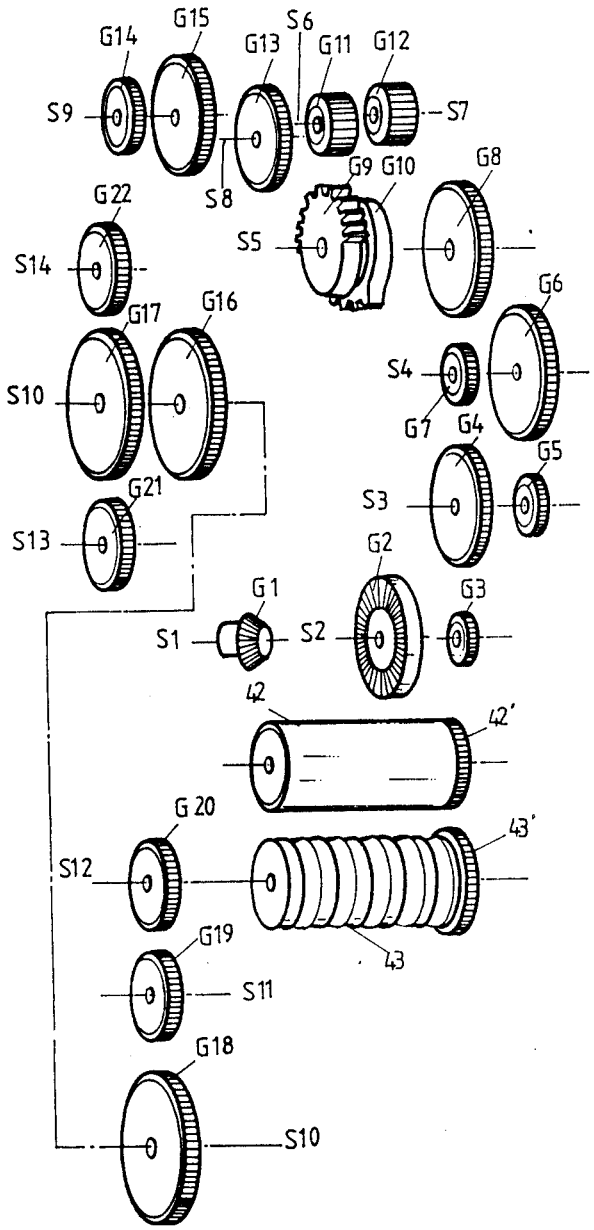
FIG. 8 is a exploded perspective view of a plurality of gear members of the device according to the present invention.
Figure 9:
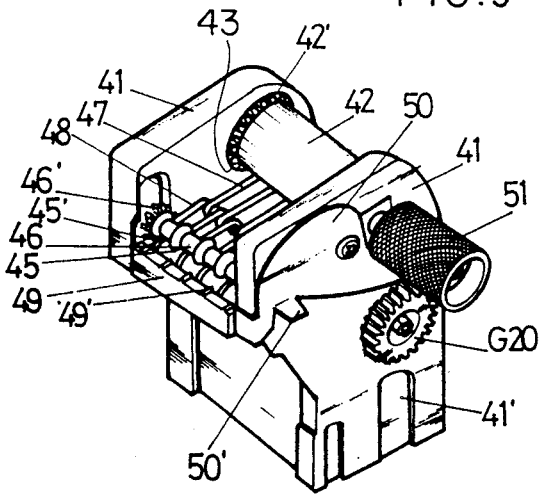
FIG. 9 is a perceptive view of a tape delivering member according to the present invention.

Tape delivering, tape cutting, and tape supplying parts according to the present invention are illustrated in FIGS. 7 and 8.

A pinion gear G1 is attached to a shaft S1 of a motor M which is disposed on the plate 24 of the motor M extending from the base plate 19 and the pinion gear G1 is geared with a rack gear G2 attached to a shaft S2, to which a small diameter spur gear G3 is attached. The spur gear G3 is geared with a large diameter spur gear G4 and a small diameter spur gear G5 is attached to the shaft S3. The spur gear G5 is geared with a large diameter spur gear G6 attached to a shaft S4, to which a small diameter spur gear G7 is attached. The spur gear G7 is geared with a large diameter spur gear G8 attached to a shaft S5, to which a large diameter spur gear G9 and a spur gear G10 in an opposite direction are attached as shown in FIG. 8. The spur gear G9 is geared with a small diameter spur gear G11 attached to a shaft S6 and the spur gear G10 is geared with a small diameter spur gear G12 attached to a shaft S7. The spur gears G11, G12 are geared with each other. The spur gear G8 is also geared with a spur gear G23.

The spur gear G11 is geared with a medium diameter spur gear G13 attached to a shaft S8. The spur gear G13 is geared with a small diameter spur gear G14 attached to a shaft S9, to which S9 a medium diameter spur gear G15 is attached. The spur gear G15 is geared with a large diameter spur gear G16 attached to a shaft S10, to which the shaft S10 a large diameter spur gear G17 and a large diameter spur gear G18 are attached. The spur gear G18 is geared with a medium diameter spur gear G19 attached to a shaft S11, and connected to a tape delivering part.

Figure 10:
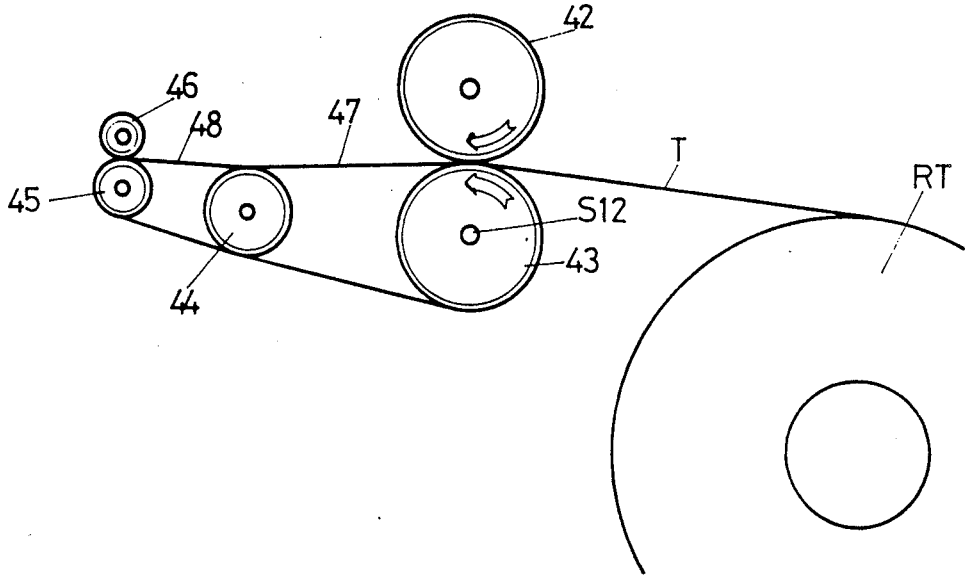
FIG. 10 shows a delivering process of the tape according to the present invention.

The spur gear G19 is geared with a medium diameter spur gear G20 attached to a shaft S12, to which S12 is attached a belt pulley 43 provided in a drawing roller installing frame 41, and the pulley 43 turns round in contact with a drawing roller 42 on the upper side thereof, as illustrated in FIG. 10. The belt pulley 43 and the drawing roller 42 are geared together by attaching spur gears 42' and 43' attached at the respective ends thereof. A medium diameter pulley 44 is arranged to interlock with the drawing roller 42 by a silicon rubber belt 47. A small diameter pulley 45 is arranged to interlock with the belt pulley 44 by a silicon rubber belt 48.

A spur gear 45' is attached to one side of the belt pulley 45 and a guide roller 46 attached to a spur gear 46' is associated with the spur gear 45' disposed in contact with the upper side of the belt pulley 45.

Besides, a refuse raking elastic member 49 is associated with a plurality of projecting members 49' provided so as to come into contact with the belt pulley 45 and the refuse raking elastic control lever 50 is attached to one side of the drawing roller installing frame 41. A press member 50' is disposed on the plan. A numeral 53 is a fastening screw.

The drawing roller 42 is elastically brought into contact with the belt pulley 43 by a spring 52 provided in the drawing roller installing frame 41. The drawing roller 42 is provided with a silicon rubber cover.

A medium diameter spur gear G21 attached to a shaft S13 is geared with the spur gear G17 which is connected to a tape cutting part. A vertical rod 27 is installed on one side of the spur gear G21. The end of the vertical rod 27 supports a horizontal rod connecting lever 28. The horizontal rod connection lever 28 is attached to a scissor operation shaft 29. The scissor operation shaft 29 is inserted into holes disposed in the shaft installing frames 30, 31. A scissor operation spring 32 is attached to the scissor operation shaft 29 and connected with a scissor installing frame 36 to which a scissor 33 and a tape drawing member 34 are furnished. In the inner side of scissor 33, a refuse raking member 33' is installed.

A medium diameter spur gear G22 attached to a shaft S14 is geared with the spur gear G17 which is connected to a tape supply ring 93. On one side of a spur gear G22, a horizontal rod 71 is installed. The horizontal rod 71 is connected to a ratchet installing frame 73 provided with a ratchet 72. The ratchet 72 engages with a ratchet gear 90 intermittently. A counter-rotation preventing member 75 is elastically disposed on the shaft plate 23. A suspension member 76 is disposed projectingly on both sides in the upper end of a ratchet gear 90. A tape drooping prevention ring 95 is inserted into the tape supplying 93 and a length lengthening support ring 94 is interposed therebetween. A plurality of catching teeth 93' is disposed in the lower end of the tape supply ring 93. A plurality of catching teeth 94', 94'' are in the lower and upper ends of the length support ring 94. A plurality of catching teeth 95' are disposed in the upper end of the tape drooping prevention ring 95.

An explanation of tape delivery length control part structure and tape supply ring rotation range control function will be given hereinafter. A ratchet is installed in the inner side of the spur gear G16 and the spur gear G18 is disposed so as to operate intermittently by the operation of the ratchet. Between the ratchet and the spur gear G18, an adjustable member 63 extends from a plate spring 62 disposed in the ring 61. The adjustable member 63 is connected to a support frame 66 connected to the plate spring 62. A support frame 66 is integrated with a medium diameter spur gear 67. The spur gear 67 is engaged with a small diameter spur gear which is connected with a tape drawing length control dial 70. A counter-rotation preventing member 69 of the spur gear G18 is disposed on the plan.

Figure 5:
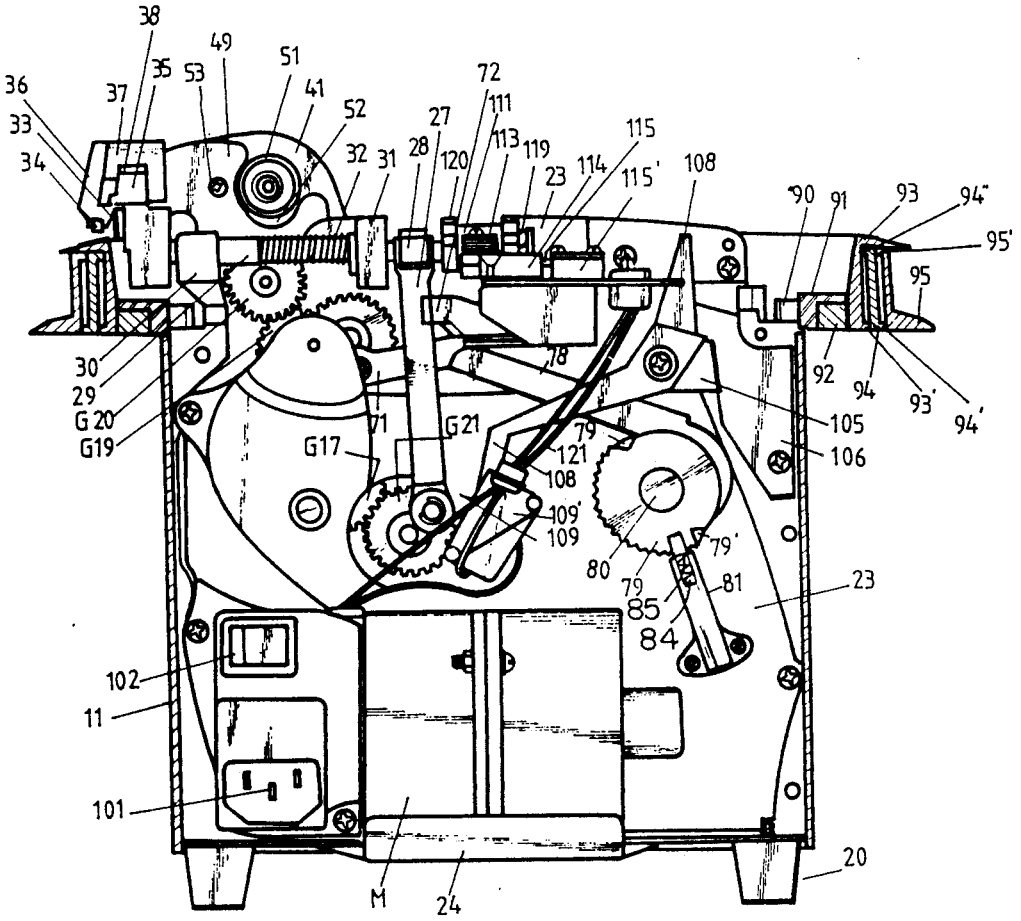
FIG. 5 is a front view of the adhesive tape cutting and supplying device of a the present invention showing in cut away the door and a tape attached ring thereof.
Figure 6:
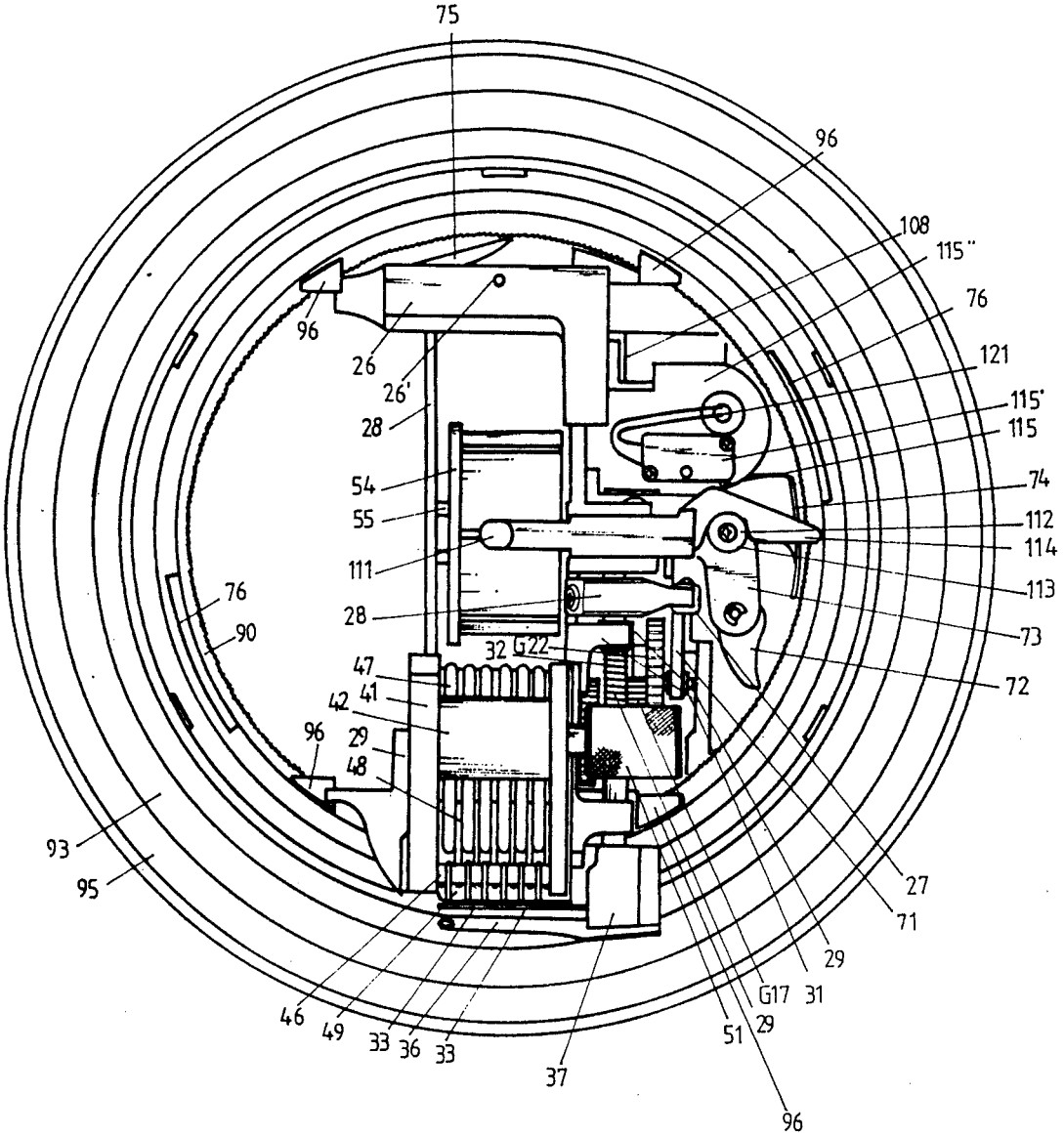
FIG. 6 is a top plan view of the device of the present invention showing in cut away the door thereof.

As shown in FIG. 5, a rotation range control member 74 is slidably attached to a vertical shaft 57. The rotating range control member 74 is extended by being connected with a connection lever 78. The connecting lever 78 is attached to a dial shaft 80, to which a manual elastic gear 79 is movably attached. The manual elastic gear 79 is brought into contact with an elastic ball 83 elastically formed by a spring 82. Both the spring 82 and the elastic ball 83 are built in an installing frame 81. The dial shaft 80 is connected to a rotating range control dial 84.

In a switch operation part, the switch operation according to the present invention can be divided into several functions, for example, an operation suspension function when the door 16 is open, an operation suspension function when the door cap 12 is open, and an operation suspension function when the tape supply ring 93 makes a half turn. In addition, a main switch 102 operation is as stated hereinabove.

Referring to the operation suspension function when the door 16 is open, a press member 104 is disposed on one side of the door 16 as shown in FIG. 4, and a pressing member 105 which is pressed by the operation of the press member 104 is movably attached to the shaft plate 23. The press member 105 is fastened to a switch operation member 108. The end of the press member 108 is enabled to come into contact with a switch 109. A lever 106 is connected to the press member 105. Numerals 107, 109 and 109', and 121 are a spring, a switch case, a switch case installation frame, and an electric wire, respectively.

Referring to the operation suspension function when the door cap 12 is open, a support part 117 of the door cap and a push member 106 which is brought into contact therewith are fastened to the switch operation member 108.

Turning to the operation suspension function when the tape supply ring 73 makes a half turn, one end of the switch operating member 114 which is operated by means of a press member 111 attached to the shaft plate 23 is brought into contact with a suspension member 76 and a swollen part thereof is made to come into contact with a switch 115. Numerals 115' and 115'' are a switch case and a switch plate, respectively.

According to the present invention, the apparatus operates as follows:

As shown in FIG. 4, a rolled adhesive tape required by the tape installation frame 54 is inserted therein while the door 16 and door cap 12 are open and the tape installing frame 54 having the rolled adhesive tape is inserted into the installation frame attaching ring 55 disposed on the side of shaft plate 23 after the attaching member 55' disposed in the installation frame attaching ring 55 is made narrower by the hand. When the attaching member 55' is released, the tape installing frame is automatically fixed. The end of the adhesive tape is fastened and inserted between the drawing roller 42 and belt pulley 43. The end of the adhesive tape is again inserted into between the belt pulley 45 and guide roller 46. Then, it is drawn as far as the portion of the scissors 33. The tape inserted between the drawing roller 42 and belt pulley 43 is transferred by turning a manual dial 51. Once the tape is drawn as far as the portion of scissors 33, the door 16 and door cap 12 are closed. When the switch 102 is turned on, the delivery, cut, and supply of tape are accomplished at some intervals. The delivery, cut, and supply of the tape is described hereinafter.

The pinion gear G1 which turns round at 1,750 r.p.m. by the motor M reduces its speed by being interlocked with the rack gear G2. The initial speed of the motor M is reduced to about 60 r.p.m. by interlocking the pinion gear G1 with rack gear G2, by interlocking the small diameter spur gear G3 attached to the same shaft S2 of rack gear G2 with the large diameter spur gear G4, by interlocking the small diameter spur gear G5 attached to the same shaft S3 of spur gear G4 with the large diameter spur gear G6, and by interlocking the small diameter spur gear G7 attached to the same shaft S4 of the spur gear G6 with the large diameter spur gear G8 attached to the shaft S5.

The spur gear G9 and the spur gear G10 which are attached to the same shaft S5 of the spur gear G8 and provided with a plurality of teeth formed on one side thereof in an opposite direction, respectively, are turned round. The spur gear G9 is interlocked with the small diameter spur gear G12. That is, when the spur gear G9 and the spur gear G11 are passed by the portion of the gear, due to mutual engagement and interlock, the spur gear G10 and the spur gear G11 are engaged and interlocked each other. Thereafter, they are turned in the opposite direction from the rotation direction of the gear which operates when the spur gear G11 is interlocked with the spur gear G9. Consequently, the spur gear G11, the spur gear G13 interlocked with spur gear G11, and the spur gear G14, the spur gear G15, the spur gear G16, and the spur gear G17 which are all interlocked with spur gear 13 operate continuously to repeat regular rotation and counter-rotation.

In cutting operation, the spur gear G21 engaged and interlocked with spur gear G17 which repeats regular rotation and counter-rotation is also repeated the regular rotation and the counter-rotation. Therefore, the rod 27 disposed on the spur gear G21 moves up and down. The scissor operation shaft 29 slidably moves from a shaft hole with a rod connection lever 28 movably attached thereto. The scissor installing frame 36 elastically moves up and down by means of a scissor operation spring 32. The tape drawing member 34 fastened to the scissors installation frame 36 moves in the same manner as the scissor 33.

The spur gear G22 engaged and interlocked with spur gear G17 which repeats the regular rotation and the counter-rotation is also repeated the regular rotation and the counter-rotation. The rod 71 disposed on the spur gear G22 repeats movement from side to side. As the ratchet installing frame 73 connected to the rod 71 moves from side to side. The ratchet 72 repeats to be engaged with a ratchet gear 90 intermittently. Accordingly, the ratchet gear 90 moves intermittently as much as the ratchet 72 moves and tape supply ring 93 turns round. At the same time, a counter-rotation preventing member 75 elastically disposed on the shaft plate 23 prevents the ratchet gear 90 from counter-rotating when it moves.

Also, the rotating range control member 74 slidably attached to a vertical shaft 57 moves from side to side by the control of a rotating range control dial 84 disposed on the outside. Since the manual elastic gear 79 integrated with a dial shaft 80 makes to move an elastic ball 83 held elastically by a spring 82 and the connection lever 79 fastened with the manual elastic gear 79 is connected with the rotating range control member 74, the rotating range control member 74 of the dial turns to the movement from side to side. Consequently, the ratchet 72 slidably moves on the inside of the rotating range control member 74 and engages with the ratchet gear 90. Since it moves the rotating range control member 74 from side to side, the rotating range of the ratchet gear 90 is changed. Thus, since the momentary rotating range of the tape supply ring 93 changes, the amount of the cut tape supply can be controlled while the tape supply ring 93 turns a half. The tape supply ring 93 is required to supply the amount, about 4 to 20 pieces in the half turn. When it makes the half turn, the delivery, the cut, and the supply operations come to a stop automatically.

That is, when the end of a switch operation member 114 attached to a press plate 11 after a spring is caught by the suspension member 76 projectingly formed on both upper sides of a rotary gear 90, the other side of switch operation member 114 is pushed in the rotation direction of the rotary gear 90 and the swollen part of switch operation piece 114 presses a switch 115 to stop all operations.

The spur gear G18 and the super gear G17 movably attached to the both side of the super gear 16, respectively, move intermittently by a ratchet disposed on the side of spur gear G16. The spur gear G18 designed to deliver the tape requires only the regular rotation, so the counter-rotation prevention member is formed. Since the spur gear G18 which repeats only the regular rotation, interlocks with the spur gear G19 and the spur gear G19 interlocks with the spur gear G20, the belt pulley 43 disposed on the same shaft of the spur gear G20 interlocks therewith. The belt pulley 43 turns round in contact with the drawing roller 42. Since the belt pulley 43 interlocks with the drawing roller 42 by the spur gears 42', 43' disposed on one end of the belt pulley 43, the tape is drawn out of the roll tape RT. The drawing roller 42 and belt pulley 43 are brought into contact with each other by a spring 52. The drawn tape is transferred with the upper part of silicon rubber belts 47, 48 disposed thereon. The tape passes between the guide roller 46 and belt pulley 45 but it is delivered as far as the portion of the scissor 33.

In addition, the rotary power of the belt pulley 43 which comes into contact with the drawing roller 42 is made to interlock with the belt pulley on the side of a cutting blade through a belt pulley 44 disposed between the belt pulley 43 and the belt pulley 45, so that the belt pulleys 43, 44, and 45 cross the silicon rubber belt 47 for minimizing time which the tape can spare for sticking to the conveyor belt by crossing the contact surface of the tape. Since the guide roller 46 is associated with the upper part of the belt pulley 45 and the surface of the tape which does not contact with the silicon rubber belt 47 is slightly pressed, it results the effect of holding up the contacting surface. Therefore, the adhesive tape cannot contact the silicon rubber belts 47, 48. A refuse raking member 49 prevents the coated tape from raking up the waste material and keeps the tape from being wound downward along the belt pulley 45.

On the other hand, a raking member 33' fastened to the inner side of the scissor 33 also prevents the coated tape from raking up the waste material when the waste material collect on the bottom blades of the scissor 33. And, the spur gear 23 engaged with the spur gear G8 is connected to a manual dial (not shown) for the manual operation if necessary.

The tape drooping prevention ring 95 and the length lengthening support ring 94 are disposed in the tape supply ring 93 for preventing the cut tape from attaching to the tape supply ring when the length of the cut tape is long. So, when the length of the cut tape is short or ordinary, the tape drooping prevention ring 95 does not use. When the length of the cut tape is long and the tape drooping prevention ring is held down, the upper of the catching teeth 94'' of the length lengthening support ring 94 are caught in the catching teeth 93' of the tape supply ring 93 and the upper catching teeth 94'' of the tape drooping prevention ring 95 is caught in the lower catching tooth 94' of the length lengthening support ring 94. Thus, the greater part of a case 11 is covered so as to solve such problems as described hereinabove.

According to the present invention, a switch operation part operates as follows:

When the door 16 is open, a press member 104 fastened thereto pushes a press member 105 movably attached to the shaft plate 23. Since the press member 105 is fastened to a switch operation member 108, the switch operating member 109 pushes a switch 109 to bring all performances to stop. When the door is closed, the switch operating member 108 takes its original position by a press attaching lever 106. When the door cap 12 is held up, a door cap support part 117 pushes the upper end of the switch operating member 108. Then, the end of the switch operating member 108 pushes the switch 109 to bring all performances to stop. When the tape supply ring 93 makes a half turn, the stop of operation is described hereinabove.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An adhesive tape cutting and supplying apparatus comprising:

means for delivering adhesive tape including:

a pinion gear and a rack gear being geared together, said rack gear being in gearing-coaxial relationship with a first spur gear, a second plurality of spur gears which are disposed in gearing relationship with each other and said first spur gear, a third pair of spur gears disposed in side-by-side relationship, a fourth pair of spur gears having opposite engaging surfaces, said fourth spur gears being coaxially connected to said second plurality of gears so that upon their rotation, they alternately engage said third pair of gears, a fifth spur gear being in gearing relationship with said third pair of spur gears, a sixth pair of coaxially disposed spur gears being in gearing relationship with said fifth spur gear, a seventh spur gear being in gearing relationship with one of said pair of sixth spur gears, said seventh spur gear having a coaxial eighth spur gear and a coaxial ninth spur gear disposed at both sides thereof, an adjustable member extending from a plate spring disposed in a ring member which is disposed between said seventh spur gear and said ninth spur gear, said adjustable member being connected to a support frame attached to a first separate spur gear which is in gearing relationship with a second separate spur gear, said second separate spur gear connected to a tape drawing length adjusting dial through a shaft, a tenth spur gear being in gearing relationship with said ninth spur gear, an eleventh spur gear being in gearing relationship with said tenth spur gear, and a belt pulley coaxially connected to said eleventh spur gear, said belt pulley being in rotatable engagement with a drawing roller by gearing relationship therewith through engaging spur gears disposed at respective ends thereof, a first belt assembly provided on said belt pulley and a first small diameter belt pulley, and a second belt assembly provided on said first small diameter belt pulley and a second small diameter belt pulley, said second small diameter belt pulley being in rotatable engagement with a guide roller, means for cutting said adhesive tape including:

a twelveth spur gear being in gearing relationship with said eighth spur gear, a vertical rod fastened to one side of said twelveth spur gear, said vertical rod holding a rod connecting lever, and a scissor shaft disposed within an aperture on a shaft installing frame and attached to said rod connecting lever which is connected to a scissor installing frame, said scissor installing frame provided with a pair of scissors and a tape drawing member, and means for supplying said adhesive tape including:

a thirteenth spur gear being in gearing relationship with said eighth spur gear, and a rod member fastened to one side of said thirteenth spur gear, said rod member connected to a ratchet installing frame containing a ratchet member for intermittently engaging with a ratchet gear so as to rotate a tape supply ring.

2. The adhesive tape cutting and supplying apparatus of claim 2, wherein a first refuse raking elastic member is provided with a plurality of projecting members for contacting said second small diameter belt pulley.

3. The adhesive tape cutting and supplying apparatus of claim 2, wherein a second refuse raking member is disposed on an inner side of an upper edge of said scissors.

4. The adhesive tape cutting and supplying apparatus of claim 1, wherein the drawing roller is provided with a silicon rubber cover.

5. The adhesive tape cutting and supplying apparatus of claim 1, wherein a rotating range control member is movably attached to a vertical shaft and connected to a connecting lever mounted to a dial shaft, said dial shaft provided with a manual elastic gear mounted thereto, said manual elastic gear being in rotatable engagement with an elastic ball connected to a spring disposed in an installing frame, said dial shaft connected to a rotating control dial for controlling the rotating range of said tape supply ring.

6.

The adhesive tape cutting and supplying apparatus of claim 1, wherein the apparatus further comprises:

a first raised member disposed at a lower end portion of said tape supply ring, a length support ring provided with a second raised member disposed at an upper end portion thereof, said length support ring having a third raised member disposed at a lower end portion thereof, and a fourth raised member disposed at an upper end portion of a tape drooping prevention ring.

* * * * *